United States Patent [19]

Moore

[11] 4,182,952

[45] Jan. 8, 1980

[54] CENTRIFUGAL SWITCH

[75] Inventor: Harry O. Moore, Charlotte, N.C.

[73] Assignee: Chris Combis; part interest

[21] Appl. No.: 829,633

[22] Filed: Sep. 1, 1977

[51] Int. Cl.[2] ..... H01H 35/10

[52] U.S. Cl. ..... 200/80 R

[58] Field of Search ..... 200/80 R, 80 A, 80 B, 200/61.46; 310/68 E

[56] References Cited

U.S. PATENT DOCUMENTS

| | | | |
|---|---|---|---|
| 2,677,539 | 5/1954 | Winslow | 200/80 R |
| 2,856,479 | 10/1958 | Fletcher | 200/80 R |
| 2,857,490 | 10/1958 | Heckethorn | 200/80 R |

*Primary Examiner*—James R. Scott

*Attorney, Agent, or Firm*—Bell, Seltzer, Park & Gibson

[57] ABSTRACT

A centrifugal switch for effecting an activation or deactivation of an electrical circuit at a predetermined rotational speed of a shaft. The switch comprises magnetic means mounted for rotation about an axis and for sliding movement under the influence of centrifugal force from a starting position adjacent the axis to an operating position radially outwardly therefrom, spring means urging the magnetic means toward the starting position, and electrical switch means operatively responsive to the movement of the magnetic means at a predetermined rotational speed so as to either activate or deactivate an associated electrical circuit.

11 Claims, 6 Drawing Figures

CENTRIFUGAL SWITCH

BACKGROUND OF THE INVENTION

This invention relates to a centrifugal switch for effecting either an activation or deactivation of an electrical circuit. The centrifugal switch can be mounted on any suitable shaft for effecting the activation or deactivation of an electrical circuit such as for any speed responsive or speed sensitive control. Examples of such controls may include electrical motor starting circuits, fan switches for heating and air conditioning installations, and machine tool clutch circuits. The magnet controlled centrifugal switch of this invention is particularly useful in combination with a split-phase electrical motor so as to deactivate a starting winding thereof at a predetermined rotational speed, and will be described hereinafter with particular reference to that environment.

Heretofore, it has been the practice for centrifugal switches to utilize a fly weight type governor in combination with a spring type switch which is secured to a housing. To control the opening and closing of an electrical circuit at a desired shaft speed, washers or shims were used to fix the distal relationship of the switch to the housing. It was previously necessary to initially obtain a precise distal relationship between the switch and the housing for prior art centrifugal switches to properly function at desired shaft speeds. Also, when an electrical motor incorporating such a switch was rebuilt, it was necessary to reestablish the precise positioning of the switch and governor on the motor shaft or the switch would either function improperly or cease to function at all.

Aslo, due to susceptibility to dirt and grime, it has been the practice to position previous centrifugal switches within the housing of the electric motor for protection. Furthermore, as the switches were not interchangeable from one type of motor to another, it has been necessary to stock a variety of different switches for use with the associated variety of different electric motors.

Magnetically-operated centrifugal switches utilizing an attraction between opposite poles of two opposing and adjacent magnets for maintaining a circuit and relying upon centrifugal force to separate the magnets and consequently deactivate a circuit have also heretofore been known and used, but this type of switchh can develop an accumulation of dirt or grime on the faces of the opposing magnetic poles over time which will detrimentally affect the performance of the switch. The magnetically-operated centrifugal switch known heretofore has a tendency due to the aforesaid accumulation of dirt and grime to activate or deactivate an associated circuit prematurely since the centrifugal force will then more readily act to separate the opposed magnets thereof.

The centrifugal switch of the present invention overcomes the problems associated with the prior art switches. Dirt or grime on the faces of the adjacent and opposing magnets has no significant effect on the performance of the centrifugal switch thereby allowing for location either within the electric motor housing or even on the shaft external to said housing. Furthermore, the inventive switch is of a standardized construction so as to fit substantially all electric motors of the same shaft diameter.

OBJECTS OF THE INVENTION

In light of the above, an object of the invention is to provide a simple and reliable centrifugal switch which at a predetermined rotational speed will effect an opening or closing of an associated circuit.

It is another object of the invention to provide a simple and reliable centrifugal switch which can be used in combination with an electric motor to effect an opening or closing of an associated circuit, such as opening a starting winding circuit, at a predetermined rotational speed of the motor.

It is yet another object of the invention to provide a simple and reliable centrifugal switch of standardized construction so as to be capable of utilization with a substantial majority of electric motors.

It is a further object of the invention to provide a simple and reliable centrifugal switch which can be mounted on the electric motor shaft either outside or inside of any motor housing.

It is a still further object of the invention to provide a switch assembly in which the magnetic elements for operating the switch and the functionally related electrical contacts are in a predetermined relationship to one another so that the entire switch assembly can be utilized in combination with a variety of motors and either within or outside of the housing thereof.

DESCRIPTION OF THE DRAWINGS

Some of the objects of the invention having been stated, others will become evident as the description proceeds, when taken in connection with the accompanying drawings, in which.

DESCRIPTION OF THE INVENTION

Figure 1:
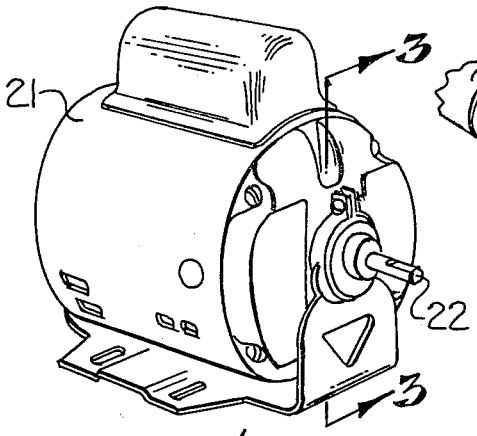
FIG. 1 is a perspective view of an electrical motor incorporating the centrifugal switch of this invention.

The centrifugal switch of this invention comprises magnetic means for exerting a magnetic field and means mounting said magnetic means for rotation about an axis and for sliding movement under the influence of centrifugal force from a starting position adjacent the axis to an operating position radially outwardly therefrom. Spring means are provided for exerting on the magnetic means a force biasing the magnetic means toward the starting position and for maintaining the magnetic means at the starting position adjacent the axis while stationary. The biasing force of the spring means is overcome by the influence of centrifugal force during rotation so as to permit the magnetic means to move to the operating position. The centrifugal switch has electrical switch means operatively responsive to movement of the magnetic means from the starting position to the operating position, in the form of a pair of contacts movable to closed or open circuit positions and a ferro-magnetic means movable axially of the axis of rotation of the magnetic means and cooperating with the contacts for maintaining them in one of the closed or open circuit positions when the ferro-magnetic means is within the effective influence of the magnetic means while in the starting position. The contacts are maintained in the other of the closed or open circuit positions when the ferro-magnetic means is outside of the effective influence of the magnetic means while the magnetic means is positioned in the operating position.

Referring now more specifically to the drawings, a preferred embodiment of a centrifugal switch according to the present invention is shown in FIGS. 1 through 6 as arranged for use with an electrical motor having a housing 21 and motor shaft 22 supported for rotation about its axis by bearings 23. The switch comprises magnetic means, shown in the form of a pair of magnets 24 positioned on opposite sides of shaft 22 with their like poles adjacent and opposing each other so as to create a repelling force therebetween. Means mounting the magnetic means, shown in part in the form of an annular, non-magnetic mounting disc 25 having a recessed portion providing a channel 27 for receiving portions of the magnets 24 therein supports the magnets 24 and provides a guide for predetermined radial sliding movement of magnets 24 between the starting position and the operating position when acted upon by centrifugal force due to the rotation of the mounting disc 25. The mounting means is further shown in the form of a rotatably mounted, non-magnetic sleeve member 26 secured to shaft 22 which is encircled by magnets 24 and has the annular, non-magnetic mounting disc 25 secured thereto so that when shaft 22 rotates both sleeve 26 and mounting disc 25 rotate therewith.

Figure 5:
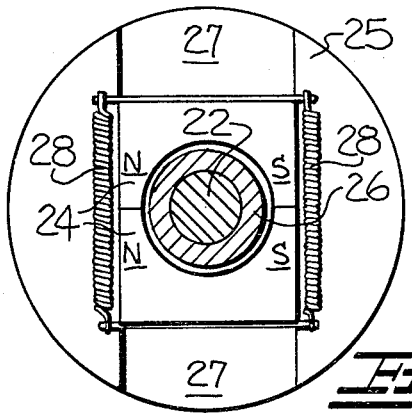
FIG. 5 is a transverse sectional view taken along line 5—5 of FIG. 3.
Figure 6:
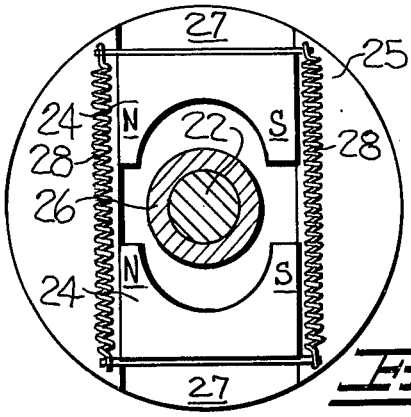
FIG. 6 is a transverse sectional view taken along line 6—6 of FIG. 4.

Spring means, shown in the form of a pair of springs 28 are affixed to magnets 24 so as to urge each of magnets 24 toward the sleeve 26 at which the like poles of magnets 24 will be substantially adjacent each other. As best illustrated in FIGS. 5 and 6, each of the two spaced apart springs 28 are positioned on opposite sides of the axis of shaft 22 urging the magnets 24 toward each other with one end of each spring 28 connected to one of the pair of magnets 24 and the other end of each spring connected to the other of the pair of magnets.

Figure 2:
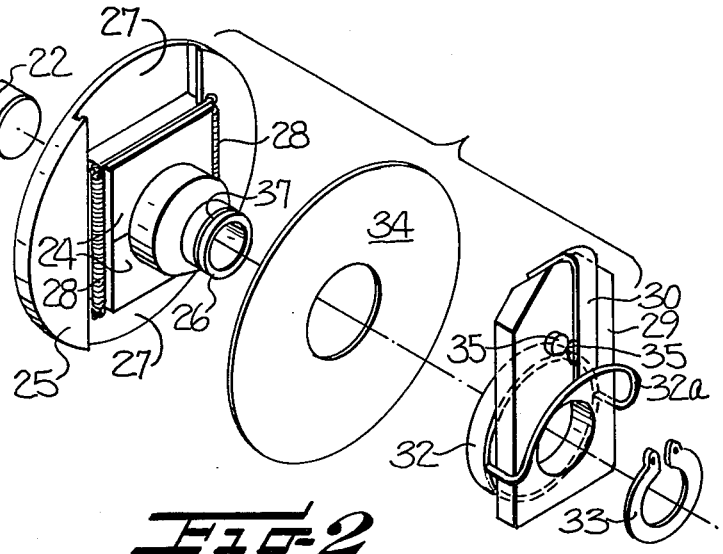
FIG. 2 is an exploded perspective view of the centrifugal switch of this invention.
Figure 3:
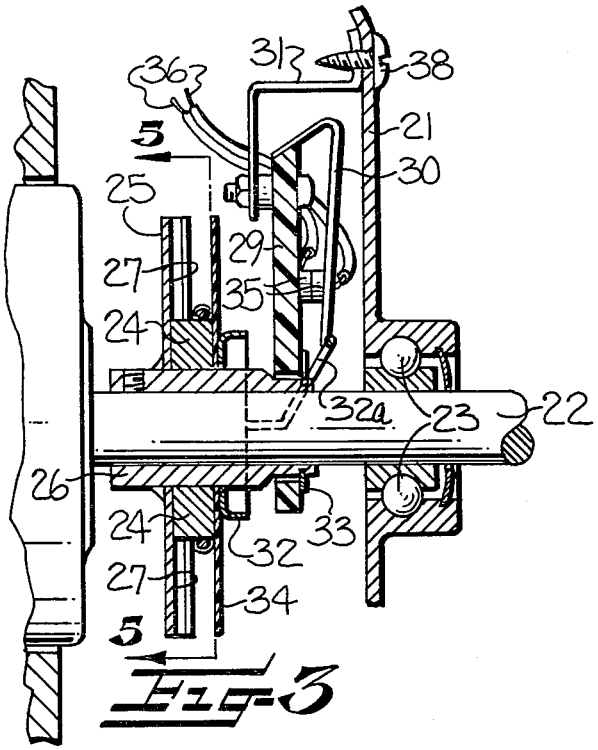
FIG. 3 is a vertical sectional view taken along line 3—3 of FIG. 1, showing the switch with the circuit closed.
Figure 4:
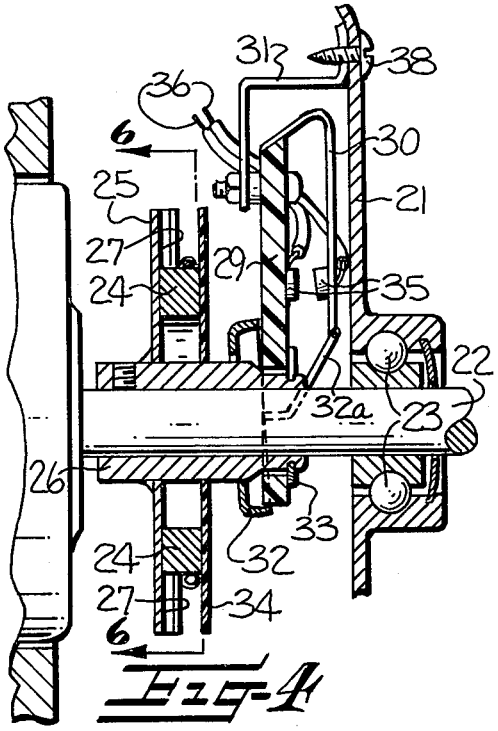
FIG. 4 is a vertical sectional view taken along line 3—3 of FIG. 1 with the circuit open.

A support member 29 loosely encircles sleeve member 26 and abuts a shoulder thereof by any conventional means, not shown, and has spring arm 30 secured at one end thereto and biased in a direction remote from magnets 24 and axially of the axis of rotation thereof. As best illustrated in FIGS. 2 and 3, the support member 29 is abutted on one side by the shoulder of sleeve 26 and by a retaining means 33 which may take the form of a snap ring adapted to be positioned in a suitable groove 37 in the periphery of sleeve 26. A bracing member 31 is affixed to support member 29 to maintain the member in a stationary position while shaft 22 rotates therethrough.

The centrifugal switch has electrical switch means in the form of a pair of contacts and a ferro-magnetic means. Ferro-magnetic means, shown in the form of a disc 32, normally attracted to magnets 24, encircles mounting sleeve 26 and is affixed to the other end of spring arm 30 by bridging member **32*a* which extends from the end of the spring arm to the ferro-magnetic disc 32 by straddling support member 29. The ferro-magnetic disc 32, although normally attracted to magnets 24, is biased by the spring arm 30 in a direction away from the magnets 24. A non-magnetic disc 34 encircles sleeve member 26 and is positioned between magnets 24 and the ferro-magnetic disc 32 for preventing mechanical contact therebetween. A pair of contacts 35 movable from closed to open circuit position and normally contacting each other are secured to proximal opposing sides of support member 29 and spring arm 30 for effecting an initially closed circuit in the starting window of an associated electric motor through a pair of wires 36** which are in electrical contact with the starting winding of the electric motor.

To secure bracing member 31 so as to prevent rotation of support member 29 with shaft 22, a motor housing bolt 38 is utilized.

Referring now more specifically to FIG. 5, the magnets 24 are there shown in their starting position on opposite sides of and substantially adjacent sleeve member 26 with springs 28 urgingly engaging magnets 24 and overcoming the repelling force of the opposing and adjacent like magnetic poles. FIG. 6 illustrates the magnets 24 forced into their operating position by the centrifugal force created by rotation of shaft 22 and sleeve 26 and mounting disc 25 secured thereto. The centrifugal force created by this rotation is sufficient to overcome the urging of pair of springs 28 and to force magnets 24 to slide radially outward along the path of the guiding channel 27 within mounting disc 25.

Preferably, sleeve member 26, annular disc 25, disc 34, and support member 29 are constructed of non-magnetic materials with support member 29 and disc 34 constructed of plastic.

In operation, the centrifugal switch of the present invention operates to disconnect the starting winding circuit of an electric motor at a predetermined rotational speed, for example eighty percent of the 1,725 revolutions per minute speed of a typical electric motor.

When a typical split-phase electric motor is activated, motor shaft 22 begins rotating and thereby also rotates sleeve member 26 and mounting disc 25 affixed to the shaft. At a predetermined speed the centrifugal force on magnets 24 overcomes the urging of the pair of springs 28 and allows magnets 24 to slide radially outward within the guiding channel 27 of mounting disc 25 from a starting position radially adjacent sleeve 26 (FIG. 5) to an operating position radially remote therefrom (FIG. 6). When the magnets 24 are in the operating position, the ferro-magnetic disc 32 which is normally attracted to magnets 24 is urged in a direction remote therefrom along the axis of rotation of shaft 22 by spring arm 30 which overcomes the relatively diminished magnetic influence on ferro-magnetic disc 32. As magnets 24 and the associated ferro-magnetic disc 32 move from the starting position, illustrated in FIGS. 5 and 3, respectively, to the operating position illustrated in FIGS. 6 and 4, respectively, electrical contacts 35 are separated by the associated movement of the bridge member **32*a* and the connected spring arm 30** which disconnects the starting winding circuit of the associated electrical motor. When the starting winding of the electric motor is disconnected after the motor has substantially achieved operating rotational speed, the motor thereafter continues to operate on its main winding.

In order to accommodate electric motors of varying shaft sizes, it is foreseen that the inventive centrifugal switch could be constructed with sleeve members 26 accommodating typical standard motor shaft sizes, for example $\frac{3}{8}''$, $\frac{1}{2}''$, $\frac{5}{8}''$, $\frac{3}{4}''$, 1" and greater. Also, to accommodate the functioning of the centrifugal switch over a range of predetermined percentages of the normal rotational speed of electrical motors, magnets 24 can be constructed of varying weights and the springs 28 can be constructed with varying tension. For example, by varying the weight of magnets 24 and tension of springs 28 the centrifugal switch can be constructed so as to activate at ninety percent of normal rotational speed of the motor as opposed to eighty percent.

It will be thus seen that there is provided, as described herebefore, a simple and reliable centrifugal switch which at a predetermined rotational speed will effect an opening or closing of an associated circuit. More specifically, a centrifugal switch is provided for disconnecting the starting winding of an associated split-phase electric motor at a predetermined rotational speed thereof.

In the drawing and specification, there has been set forth a preferred embodiment of the invention, and although specific terms are employed, they are used in a generic and descriptive sense only and not for purposes of limitation.

What is claimed is:

1. A centrifugal switch which comprises:

magnetic means for exerting a magnetic field;

means mounting said magnetic means for rotation about an axis and for radial sliding movement under the influence of centrifugal force from a starting position adjacent said axis to an operating position radially outwardly therefrom;

spring means for exerting on said magnetic means a force biasing said magnetic means toward the starting position and for maintaining said magnetic means at the starting position adjacent the axis while stationary, the biasing force of said spring means being overcome by the influence of centrifugal force so as to permit said magnetic means to move to the operating position; and electrical switch means operatively responsive to movement of said magnetic means from the starting position to the operating position, said electrical switch means including a pair of contacts movable to closed and open circuit positions and ferro-magnetic means movable axially of the axis of rotation of said magnetic means and cooperating with said contacts for maintaining said contacts in one of said closed and open circuit positions when said ferro-magnetic means is within the effective influence of said magnetic means while the magnetic means is positioned in the starting position and for maintaining said contacts in the other of said closed and open circuit positions when said ferro-magnetic means is outside of the effective influence of said magnetic means while the magnetic means is positioned in the operating position.

2. A centrifugal switch as claimed in claim 1, wherein said magnetic means comprises a pair of permanent magnets slidably engaging said mounting means and positioned with like poles adjacent and opposing each other so as to create an effective repelling magnetic field therebetween.

3. A centrifugal switch as claimed in claim 1, wherein said means mounting said magnetic means comprises a rotatably mounted, nonmagnetic sleeve member and an annular, nonmagnetic disc mounted on said sleeve member, said magnetic means being mounted for sliding movement on said disc.

4. A centrifugal switch as claimed in claim 1, wherein said electrical switch means further comprises a spring arm connected to said ferro-magnetic means and carrying one of said contacts, said spring arm biasing said ferro-magnetic means in a direction away from said magnetic means, and a support member positioned on said mounting means and being connected to said spring arm for supportingly carrying the spring arm, said support member carrying the other contact of said pair of contacts.

5. A centrifugal switch as claimed in claim 4, including a nonmagnetic disc positioned between said magnetic means and said ferro-magnetic means so as to prevent mechanical contact therebetween.

6. A centrifugal switch which comprises:

a pair of permanent magnets positioned with like poles adjacent and opposing each other so as to create an effective repelling magnetic field therebetween;

means mounting said pair of magnets on opposite sides of an axis for rotation about the axis and for radial movement under the influence of centrifugal force from a starting position adjacent said axis to an operating position radially outwardly therefrom;

spring means engaging said pair of permanent magnets, said spring means biasing said permanent magnets toward the starting position and maintaining said magnets at the starting position adjacent the axis while stationary, the biasing force of said spring means being overcome by the influence of centrifugal force so as to permit said magnets to move to the operating position; and electrical switch means operatively responsive to movement of said magnets from the starting position to the operating position, said electrical switch means including a pair of contacts movable to closed and open circuit positions and ferro-magnetic means cooperating with said contacts for maintaining said contacts in one of said closed and open circuit positions when said ferro-magnetic means is within the effective influence of said magnets while the magnets are positioned in the starting position and for maintaining said contacts in the other of said closed and open circuit positions when said ferro-magnetic means is outside of the effective influence of said magnets while the magnets are in the operating position.

7. A centrifugal switch as claimed in claim 6, wherein said pair of permanent magnets slide upon said mounting means during radial movement under the influence of centrifugal force from the starting position adjacent the axis to the operating position radially outwardly therefrom.

8. A centrifugal switch as claimed in claim 7, wherein said spring means comprises two spaced-apart springs positioned on opposite sides of the axis urging said pair of magnets toward each other, one end of each spring connected to the first of said pair of magnets and the other end of each spring connected to the second of said pair of magnets.

9. A centrifugal switch as claimed in claim 6, wherein said means mounting said pair of magnets comprises a rotatably mounted, nonmagnetic sleeve member and an annular, nonmagnetic disc mounted on said sleeve member, said magnets being mounted for sliding movement against on said disc.

10. A centrifugal switch as claimed in claim 9, wherein said annular, nonmagnetic disc has a recessed portion for receiving portions of said magnets therein and for guiding said magnets in a predetermin d radial path between the starting position and the operating position.

11. A centrifugal switch as claimed in claim 9, wherein said sleeve has a shoulder and said electrical switch means further includes a support member supported on said sleeve member and abutting said shoulder, a spring arm affixed to said support member and biased axially of the axis of rotation away from said magnets and having secured to one end thereof said ferro-magnetic means whereby said support member and said magnets are maintained in a fixed spaced relationship to each other.

* * * * *

UNITED STATES PATENT AND TRADEMARK OFFICE

CERTIFICATE OF CORRECTION

PATENT NO. : 4,182,952

DATED : January 8, 1980

INVENTOR(S) : Harry O. Moore

It is certified that error appears in the above-identified patent and that said Letters Patent are hereby corrected as shown below:

Column 1, Line 36, "Aslo" should be --Also--; same column, Line 49, "switchh" should be --switch--. Column 3, Lines 44 and 45, delete "by any conventional means, not shown,"; same column, Line 46, after "thereto" insert --by any conventional means, not shown,--.
Column 6, CLAIM 9, Line 62, delete "against"

Signed and Sealed this

*Fifteenth* Day of *July 1980*

[SEAL]

*Attest:*

SIDNEY A. DIAMOND

*Attesting Officer*

*Commissioner of Patents and Trademarks*